US006397489B1

(12) United States Patent
Choi

(10) Patent No.: US 6,397,489 B1
(45) Date of Patent: Jun. 4, 2002

(54) MULTIPORT CYLINDER DRYER WITH LOW THERMAL RESISTANCE AND HIGH HEAT TRANSFER

(75) Inventor: Stephen U. Choi, Lisle, IL (US)

(73) Assignee: The University of Chicago, Chicago, IL (US)

( * ) Notice: Subject to any disclaimer, the term of this patent is extended or adjusted under 35 U.S.C. 154(b) by 0 days.

(21) Appl. No.: 09/648,693

(22) Filed: Aug. 25, 2000

(51) Int. Cl.[7] ..... F26B 11/02
(52) U.S. Cl. ..... 34/114
(58) Field of Search ..... 34/114, 108, 109, 34/110, 111, 112, 113, 115, 118, 457, 117

(56) References Cited

U.S. PATENT DOCUMENTS 2,299,662 A * 10/1942 Thaler ..... 34/111
3,659,347 A * 5/1972 Wallsten ..... 34/350
3,822,485 A * 7/1974 Bates
3,968,572 A * 7/1976 Stuchberry ..... 34/134
4,155,177 A * 5/1979 Justus ..... 34/110
4,194,299 A * 3/1980 Wiberg et al. ..... 34/124
4,442,876 A * 4/1984 Koike et al. ..... 144/2.1
4,462,868 A * 7/1984 Oubridge et al. ..... 162/280
4,955,268 A * 9/1990 Ickinger et al. ..... 492/46
5,079,853 A * 1/1992 Kurokawa ..... 34/60
5,416,979 A * 5/1995 Joiner ..... 34/114
5,830,321 A * 11/1998 Lindsay et al.
5,842,285 A * 12/1998 Veen ..... 34/108
6,085,437 A * 7/2000 Stipp ..... 34/115
6,161,302 A * 12/2000 Rantala ..... 34/119
6,185,836 B1 * 2/2001 Zaoralek ..... 34/119

* cited by examiner

*Primary Examiner*—Teresa Walberg
*Assistant Examiner*—Daniel Robinson
(74) *Attorney, Agent, or Firm*—Joan Pennington

(57) ABSTRACT

A multiport cylinder dryer for use with drying a web of pulp, paper, or similar material, and a method for drying a moving web of pulp, paper, or similar material are provided. The multiport cylinder dryer includes an outer cylinder dryer surface for transferring heat to a moving web to be dried. A plurality of multiport flow passages are positioned close to the outer cylinder dryer surface. The multiport flow passages are arranged for channeling steam flow for heating the cylinder dryer surface. The multiport cylinder dryer achieves significantly higher drying rates than conventional dryers by minimizing the condensate layer and maximizing the heat transfer surface area. The dominant heat transfer mode in the multiport cylinder dryer is convection, which is significantly more effective than conduction, the dominant heat transfer mode in conventional dryers.

14 Claims, 3 Drawing Sheets

MULTIPORT CYLINDER DRYER WITH LOW THERMAL RESISTANCE AND HIGH HEAT TRANSFER

CONTRACTUAL ORIGIN OF THE INVENTION

The United States Government has rights in this invention pursuant to Contract No. W-31-109-ENG-38 between the United States Government and Argonne National Laboratory.

FIELD OF THE INVENTION

The present invention relates to a multiport cylinder dryer having improved thermal resistance and improved heat transfer for use in drying pulp and paper.

DESCRIPTION OF THE RELATED ART

The pulp and paper industry is among the most capital intensive manufacturing industries in the United States. The large dryers that remove residual water from the pulp and paper are the costliest components associated with papermaking. These dryers also consume more energy than other components of the paper machine and offer significant opportunities for applying cost saving measures. A need exists for a mechanism to significantly improve the heat transfer from conventional steam cans.

Conventional steam dryer cans are simply large cast iron cylinders into which pressurized steam is used to heat the cylinder walls. This type of steam can is a very simple heat transfer device. Heat is transferred from the steam inside the dryers to the wet sheet outside the dryers, providing the energy required for evaporation. As the heat is transferred from the steam, most of the steam condenses inside the dryer cans. The condensation that is formed often interferes with heat transfer to the wall.

Drying is one of the most common unit operations used in diverse processes in the agricultural, ceramic, chemical, food, pharmaceutical, pulp and paper, mineral, polymer, and textile industries. Therefore, the dryer technology is cross-cutting with a range of applications and many industries could expect significant benefits from an improved cylinder dryer.

A principal object of the present invention is an improved cylinder dryer for use in drying pulp and paper and the like.

It is another object of the present invention to provide such an improved cylinder dryer having improved thermal resistance and improved heat transfer.

It is another object of the present invention to provide a multiport cylinder dryer having improved thermal resistance and improved heat transfer for use in drying pulp and paper and the like.

It is another object of the present invention to provide such multiport cylinder dryer for maximizing drying rates in drying pulp and paper and the like.

It is another object of the present invention to provide such multiport cylinder dryer for maximizing drying rates in drying pulp and paper and the like by maximizing heat transfer from steam into the material to be dried, such as pulp and paper and the like.

SUMMARY OF THE INVENTION

In brief, a multiport cylinder dryer for use with drying a web of pulp, paper, or similar material, and a method for drying a moving web of pulp, paper, or similar material are provided. The multiport cylinder dryer includes an outer cylinder dryer surface for transferring heat to a moving web to be dried. A plurality of multiport flow passages are positioned close to the outer cylinder dryer surface. The multiport flow passages are arranged for channeling steam flow for heating the cylinder dryer surface.

In accordance with features of the invention, the multiport cylinder dryer achieves significantly higher drying rates than conventional dryers by minimizing the condensate layer and maximizing the heat transfer surface area. The dominant heat transfer mode in the multiport cylinder dryer is convection, which is significantly more effective than conduction, the dominant heat transfer mode in conventional dryers.

BRIEF DESCRIPTION OF THE DRAWINGS

The present invention together with the above and other objects and advantages may best be understood from the following detailed description of the preferred embodiments of the invention illustrated in the drawings, wherein.

DETAILED DESCRIPTION OF THE PREFERRED EMBODIMENTS

Figure 1A:
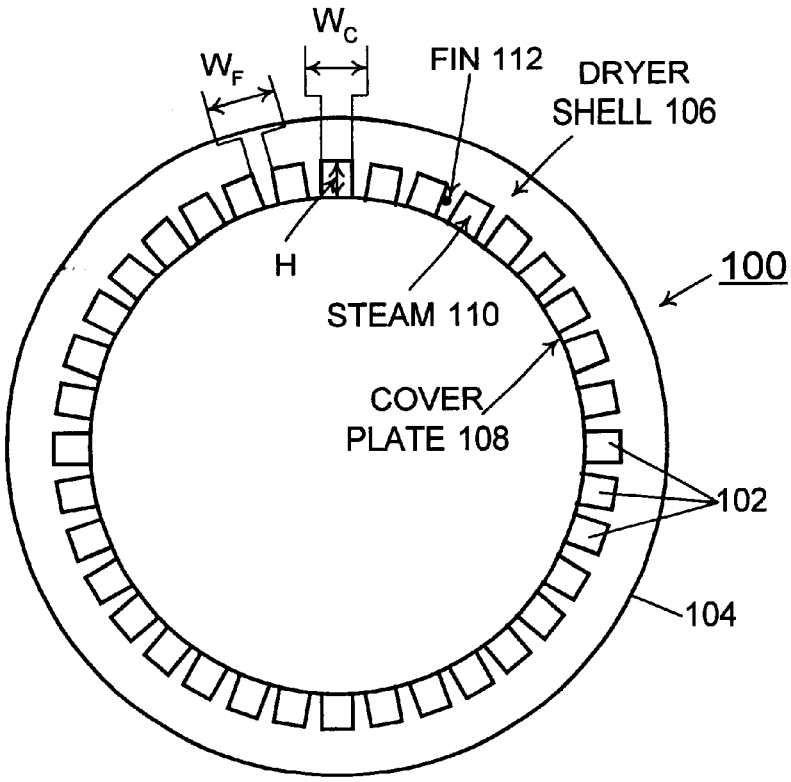
FIGS. 1A and 1B are diagrams illustrating multiport cylinder dryers in accordance with the present invention.

Having reference now to the drawings, in FIG. 1A, there is shown a multiport cylinder dryer of the preferred embodiment generally designated by the reference character 100. Multiport cylinder dryer 100 is a dryer type used for the paper industry, where heat from steam is transferred across a cylinder wall to a web of moving paper. As shown in FIG. 1A, multiport cylinder dryer 100 includes a plurality of ports or multiport longitudinally oriented flow passages 102 close to the cylinder dryer surface 104.

In accordance with features of the invention, the new concept of a multiport dryer 100 is to flow the steam through multiport longitudinally oriented flow passages 102 close to the cylinder dryer surface 104. This innovative multiport dryer 100 achieves significantly higher drying rates than conventional dryers by minimizing the condensate layer and maximizing the heat transfer surface area. Also, the dominant heat transfer mode in the new multiport dryer design is convection, which is markedly more effective than conduction, the dominant heat transfer mode in conventional dryers. All of these factors contribute to extremely high coefficients of condensing heat transfer. The innovative multiport dryer 100 of the preferred embodiment can be used to reshape next-generation dryers.

A series of steam condensing tests have shown that the condensing heat transfer coefficient for multiport dryers 100 is approximately 2642 Btu/hr-ft$^2$-° F. (15,000 W/m$^2$K), or about 7 times greater than that in a conventional dryer with spoiler-bar enhancement and about 20 times greater than that in a conventional dryer without spoiler bars.

Furthermore, the tests showed that dryer shell surface temperatures are more uniform in multiport dryers 100 than in conventional dryers.

Multiport cylinder dryer 100 of FIG. 1A includes a cylinder dryer shell 106 with the multiple flow passages or ports 102 fabricated directly into the cylinder dryer shell 106. A cover plate 108 together with the cylinder dryer shell 106 define the multiple flow passages or ports 102. Steam 110 flows in or out through the multiple flow passages 102. Two-phase flow can occur in part or all of the flow passages 102. The flow passages 102 are also called mini-channels or microchannels, because the height H and the width Wc are typically less than 10 mm, and could be as small as 100 microns. A space Wf between channels 102 is typically less than the channel width Wc, as shown in FIG. 1A. The channels 102 and an associated fin 112 can take on a wide variety of aspect ratios. Also, the channels 102 can be a variety of shapes. The cover plate 108 can be either a thermal conductor or an insulator.

Flow channels 102 can occur on either side of the dryer shell 106. In the multiport cylinder dryer 100 of FIG. 1A, the flow channels 102 are formed on the inside of the dryer shell 106.

Figure 1B:
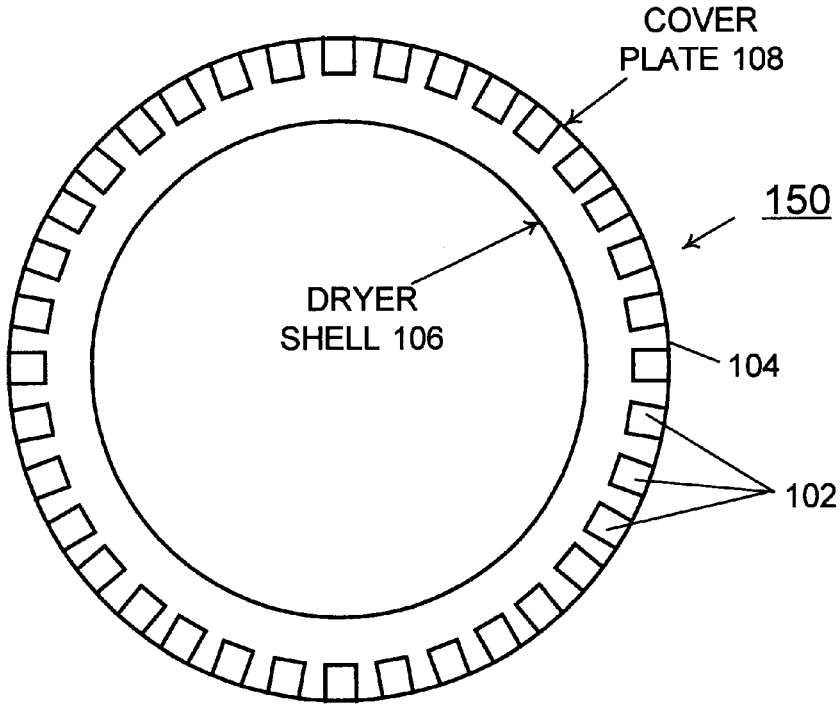

Referring also to FIG. 1B, another multiport cylinder dryer 150 is shown. In FIG. 1B, the same reference numbers are used for similar or identical components as used with respect to the multiport cylinder dryer 100 of FIG. 1A. In the multiport cylinder dryer 150 of FIG. 1B, the flow channels 102 are formed on the outside of the dryer shell 106. A cover plate 108 is used together with the cylinder dryer shell 106 to define the multiple flow passages or ports 102. The cover plate 108 in the multiport cylinder dryer 150 completes the enclosure of the passages 102 and provides the outer drying surface 104. In the multiport cylinder dryer 150 of FIG. 1B, the cover plate 108 is thin and should also have a high thermal conductivity. Contact resistance between the cover plate 108 and the cylinder dryer shell 106 must also be kept small.

The flow channels 102 can be formed by various techniques, such as cutting, stamping, milling slots or corrugating plates. Tubes can be used to form multiport channels to serve as "pressure vessels," allowing for a thinner dryer shell 106 which can be fabricated less expensively than casting. The cover plate 108 can be permanently attached to the cylinder dryer shell 106 by welding. Alternatively, the cover plate 108 can be mechanically clamped to the cylinder dryer shell 106 which allows removal if needed.

Multiport cylinder dryer 100 of FIG. 1A and multiport cylinder dryer 150 of FIG. 1B are arranged for new applications. It should be noted that the multiport cylinder dryer 150 shown in FIG. 1B can be used as a retrofit module for retrofit applications. Retrofit modules are installed inside existing dryers as shown in FIG. 2.

Figure 2:
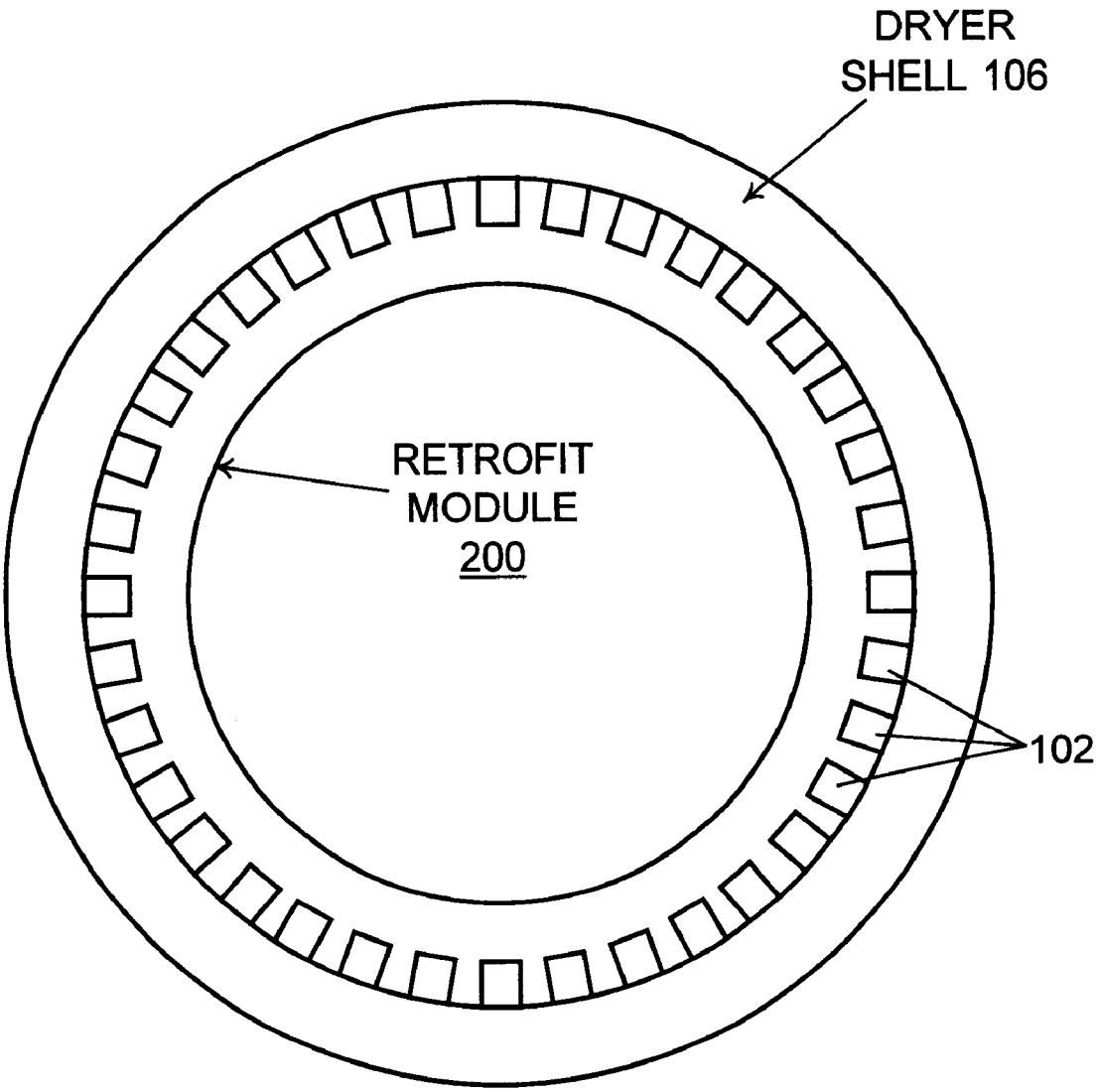
FIG. 2 is a diagram illustrating another multiport cylinder dryer in accordance with the present invention.

In FIG. 2, the same reference numbers are used for similar or identical components as used with respect to the multiport cylinder dryer 100 of FIG. 1A. A basic embodiment of a multiport cylinder dryer 200 of the invention for retrofit applications is shown in FIG. 2. The retrofit module 200 in FIG. 2 has no cover plate because the inner surface of the existing dryer shell 106 acts as the cover plate for the grooves in the retrofit module 200 to form the flow channels 102. However, when a retrofit module has a cover plate, the area between the cover plate 108 and existing dryer shell 106 may have to be filled with thermally conducting materials to minimize contact resistance between the cover plate and dryer shell.

Figure 3:
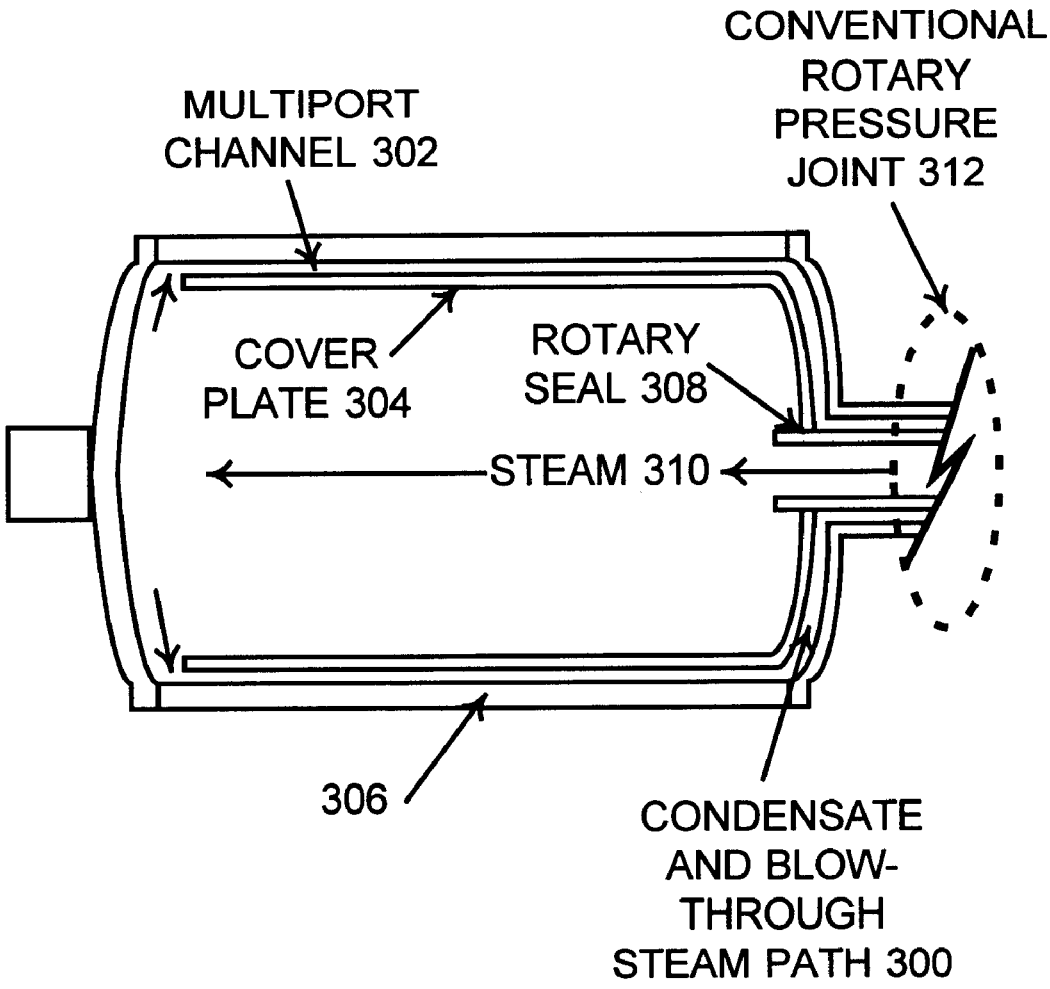
FIG. 3 is a diagram illustrating an example blow-through steam path in a multiport cylinder dryer in accordance with the present invention.

Referring also to FIG. 3, there is shown an example blow-through condensate and steam path 300, for example, such as in the multiport cylinder dryer 100 in accordance with the present invention. A multiport channel 302 is defined between a cover plate 304 and a dryer shell 306. Multiport channel 302 includes multiple flow channels or ports 102, such as shown in FIG. 1A. A rotary seal 308 is provided at an inlet of a steam 310. A conventional rotary pressure joint 312 is shown with the inlet of a steam 310.

While the present invention has been described with reference to the details of the embodiments of the invention shown in the drawing, these details are not intended to limit the scope of the invention as claimed in the appended claims.

What is claimed is:

1. A multiport cylinder dryer for use with drying a web of pulp, paper, or similar material, said multiport cylinder dryer comprising:

an outer cylinder dryer surface for transferring heat to a moving web to be dried;

a plurality of multiport longitudinally oriented flow passages, said longitudinally oriented flow passages positioned close to said outer cylinder dryer surface; and said multiport longitudinally oriented flow passages for channeling steam flow longitudinally substantially without circumferential steam flow between said multiport longitudinally oriented flow passage for heating said cylinder dryer surface and providing convection with phase change substantially as a heat transfer mode for the multiport cylinder dryer.

2. A multiport cylinder dryer as recited in claim 1 wherein said plurality of multiport flow passages are located on an inside of a dryer shell and further includes a cover plate for forming said multiport flow passages for improved steam flow.

3. A multiport cylinder dryer as recited in claim 1 wherein said plurality of multiport flow passages are located on an outside of a dryer shell and further includes a cover plate for forming said multiport flow passages for improved steam flow and said cover plate providing said outer cylinder dryer surface for transferring heat to a moving web to be dried.

4. A multiport cylinder dryer as recited in claim 3 wherein said cover plate has a high thermal conductivity.

5. A multiport cylinder dryer as recited in claim 1 wherein said plurality of multiport flow passages are formed by cutting, stamping, milling slots or corrugating plates.

6. A multiport cylinder dryer as recited in claim 1 wherein said plurality of multiport flow passages channels two-phase steam flow in a blow-through condensate and steam path without forming substantial steam condensation; whereby thermal resistance associated with condensate is limited.

7. A multiport cylinder dryer as recited in claim 1 wherein said plurality of multiport flow passages providing a defined steam heat transfer surface area include a set space between channels of less than a channel width.

8. A multiport cylinder dryer as recited in claim 1 wherein said plurality of multiport flow passages providing steam heat transfer to said outer cylinder dryer surface include a channel width and a channel height of less than 10 mm and a set space between channels of less than said channel width.

9. A multiport cylinder dryer as recited in claim 1 wherein said plurality of multiport flow passages are microchannels, each having a height and a width of less than 10 mm.

10. A multiport cylinder dryer as recited in claim 1 wherein said outer cylinder dryer surface has a generally uniform surface temperature.

11. A multiport cylinder dryer as recited in claim 1 wherein said outer cylinder dryer surface is provided by a cylindrical dryer shell and said plurality of multiport flow passages engage an inside surface of said cylindrical dryer shell for forming said multiport flow passages.

12. A multiport cylinder dryer as recited in claim 1 wherein said multiport flow passages include a height and a channel width of less than 100 mm.

13. A multiport cylinder dryer as recited in claim 12 wherein said multiport flow passages include a space Wf between channels of typically less than said channel width Wc.

14. A method for drying a moving web of pulp, paper, or similar material comprising the steps of:

providing an outer cylinder dryer surface for transferring heat to the moving web;

providing a plurality of multiport longitudinally oriented flow passages, said longitudinally oriented flow passages positioned close to said outer cylinder dryer surface; and channeling steam flow longitudinally through said plurality of said multiport longitudinally oriented flow passages substantially without circumferential steam flow between said multiport longitudinally oriented flow passages for heating said cylinder dryer surface and providing convection with phase change substantially as a heat transfer mode for the multiport cylinder dryer.

* * * * *